US005919421A

United States Patent [19]

Monz et al.

[11] Patent Number: 5,919,421

[45] Date of Patent: Jul. 6, 1999

[54] LID SUPPORT ARRANGEMENT FOR A DOUBLE LID LOCK

[75] Inventors: Michael Monz, Bottrop; Heimut Lehning, Barenburg, both of Germany

[73] Assignee: Forschungszenlrum Karlsruhe GmbH, Karlsruhe, Germany

[21] Appl. No.: 09/070,027

[22] Filed: Apr. 30, 1998

Related U.S. Application Data

[63] Continuation-in-part of application No. PCT/EP96/05102, Nov. 19, 1996.

[30] Foreign Application Priority Data

Dec. 21, 1995 [DD] German Dem. Rep. ..... 195 48 118

[51] Int. Cl.[6] ..... B01L 3/00

[52] U.S. Cl. ..... 422/102; 49/254; 220/817; 220/823; 220/830; 588/249; 588/259

[58] Field of Search ..... 422/292, 295, 422/900, 102; 49/254; 220/908, 810, 817–819, 822, 823, 830; 588/249, 259, 900, 261

[56] References Cited

U.S. PATENT DOCUMENTS

| | | | |
|---|---|---|---|
| 2,337,948 | 12/1943 | Vani | 49/254 |
| 2,917,987 | 12/1959 | Hansen et al. | 49/254 |
| 3,888,045 | 6/1975 | Piegza | 49/255 |
| 4,262,447 | 4/1981 | Schneier et al. | 49/254 |
| 4,932,160 | 6/1990 | Sperko | 49/254 |

FOREIGN PATENT DOCUMENTS

| | | |
|---|---|---|
| 0 429 813 | 6/1991 | European Pat. Off. . |
| 0 586 307 | 3/1994 | European Pat. Off. . |
| 2 315 513 | 10/1973 | Germany . |

*Primary Examiner*—Elizabeth McKane
*Assistant Examiner*—Fariborz Moazzam
*Attorney, Agent, or Firm*—Klaus J. Bach

[57] ABSTRACT

In a lid support arrangement for a double lid lock for closing the openings of two containments disposed adjacent one another for transferring noxious materials between the containments, a cover lid for sealing the opening between the containments is supported by a pivot arm structure which is pivotally supported at one end and extends over the cover lid and the cover lid is attached to the pivot arm structure by a pivot joint having an axis extending parallel to the pivot axis of the pivot arm structure.

1 Claim, 3 Drawing Sheets

LID SUPPORT ARRANGEMENT FOR A DOUBLE LID LOCK

This is a continuation-in-part application of international application PCT/EP96/05102 filed Nov. 19, 1996 and claiming priority of German appl. No. 195 48 118.6 filed Dec. 21, 1995.

BACKGROUND OF THE INVENTION

The invention relates to a lid support arrangement for a double lid lock for closing adjacent openings of containments, preferably for coupling of a noxious material container to the bottom opening of a containment with an outer lid which is disposed on the bottom opening and which can be removed by an apparatus and utilized as the outer lid of a double lid lock system.

Double lid lock designs known in the art require guide cylinders for lifting the cover lid in order to move the cover lid vertically off the base plate out of its sealing engagement with the containment before it can be pivoted out of the way along a circular arc. This movement is required on one hand to prevent jamming of the lid within the flange and, on the other hand, to prevent damage to the seals by rubbing especially if, for space reasons, the pivot axis is disposed closely adjacent the lid.

It is the object of the present invention to provide a novel double lid lock with an end lid which can be vertically lifted off its seat in a simple manner and which also can be vertically lowered onto its seat so that the seals are not damaged during removal and replacement of the lid.

SUMMARY OF THE INVENTION

In a lid support arrangement for a double lid lock for closing the openings of two containments disposed adjacent one another for transferring noxious materials between the containments, a cover lid for sealing the opening between the containments is supported by a pivot arm structure which is pivotally supported at one end and extends over the cover lid and the cover lid is attached to the pivot arm structure by a pivot joint having an axis extending parallel to the pivot axis of the pivot arm structure whereby the lid can be lifted initially vertically from the opening.

In addition to the vertical lifting, it is an advantage of the invention that, because of the movability of the pivot axis for the lid, the dimensions of the double lid lock mechanism can be relatively small since the pivot axis may be disposed directly adjacent to the lid since the pivot axis is movable during opening or closing of the lid. In addition, the opening may have any shape, that is, it may be circular, oblong, or square.

In addition to the vertical lifting, it is an advantage of the invention that, because of the movability of the pivot axis for the lid, the dimensions of the double lid lock mechanism can be relatively small since the pivot axis may be disposed directly adjacent to the lid since the pivot axis is movable during opening or closing of the lid and that the opening may have any shape, that is, it may be circular, oblong, or square.

Detail feature of the invention will be described below on the basis of FIGS. 1 to 3.

DESCRIPTION OF A PREFERRED EMBODIMENT

Figure 1:
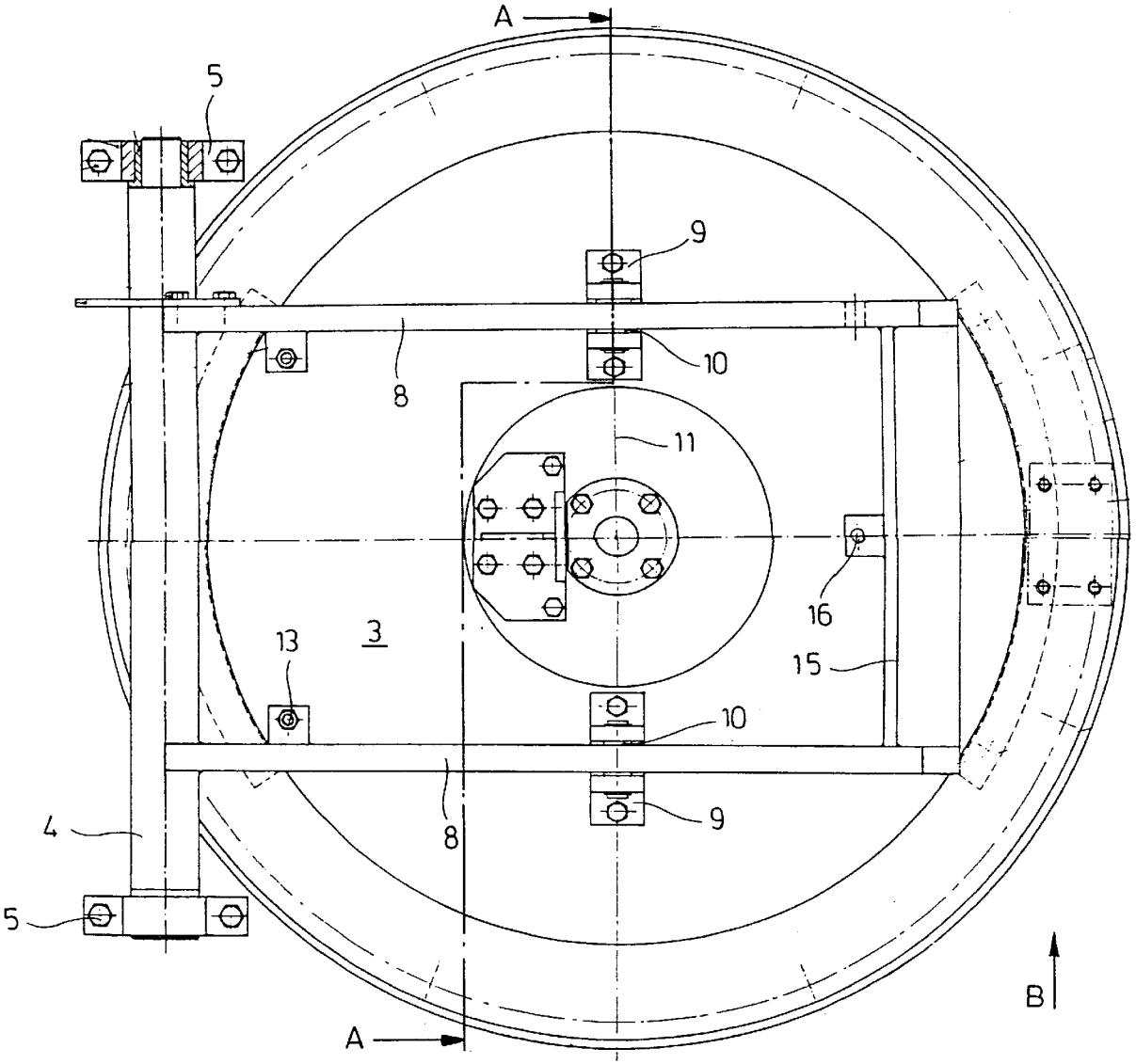
FIG. 1 is a top view of a double lid lock with a round lid for a round opening wherein, however, other shapes such as oblong, square or other polygonal shapes may be used for the lock openings and the lids.
Figure 2:
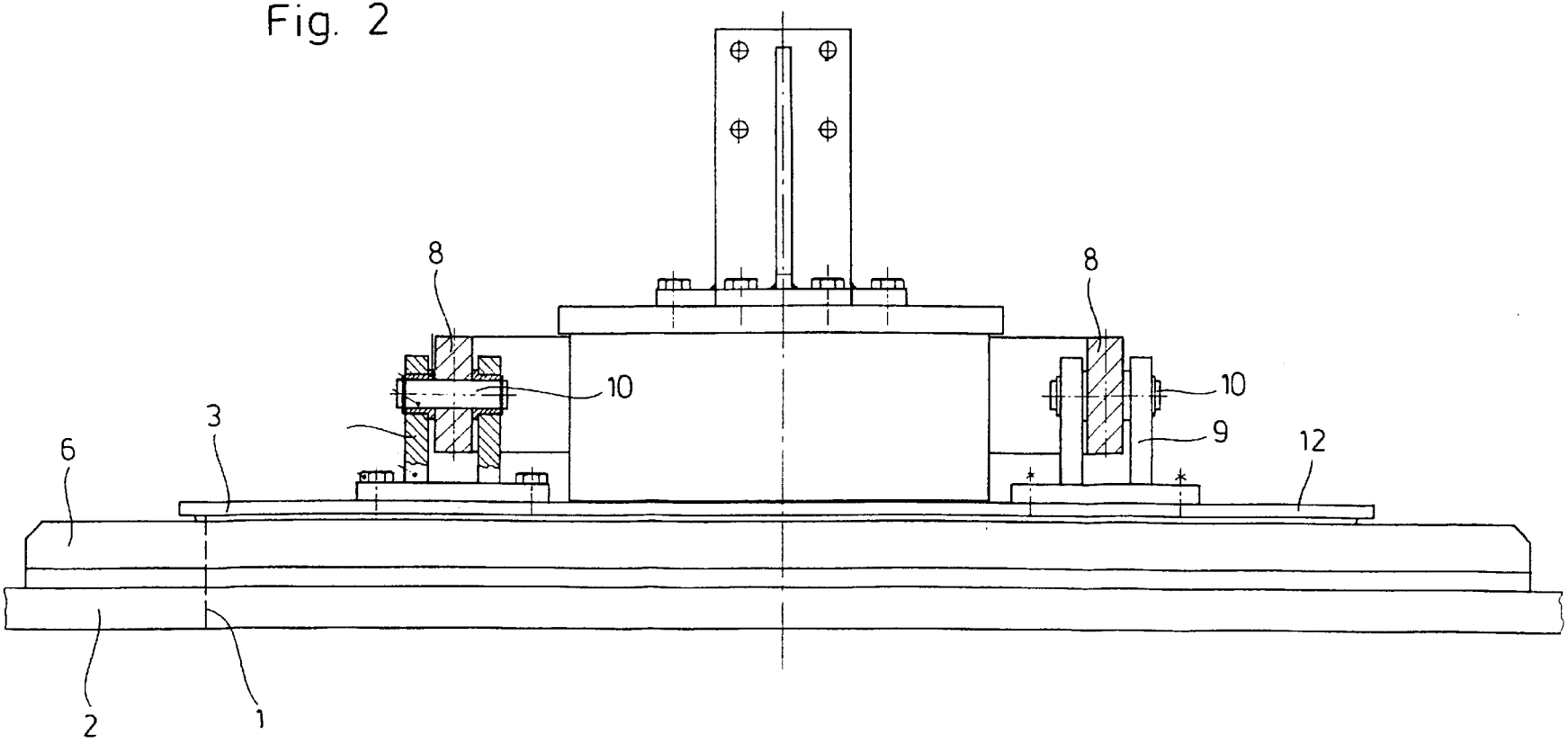
FIG. 2 is a sectional view taken along lines A—A of FIG. 1.
Figure 3:
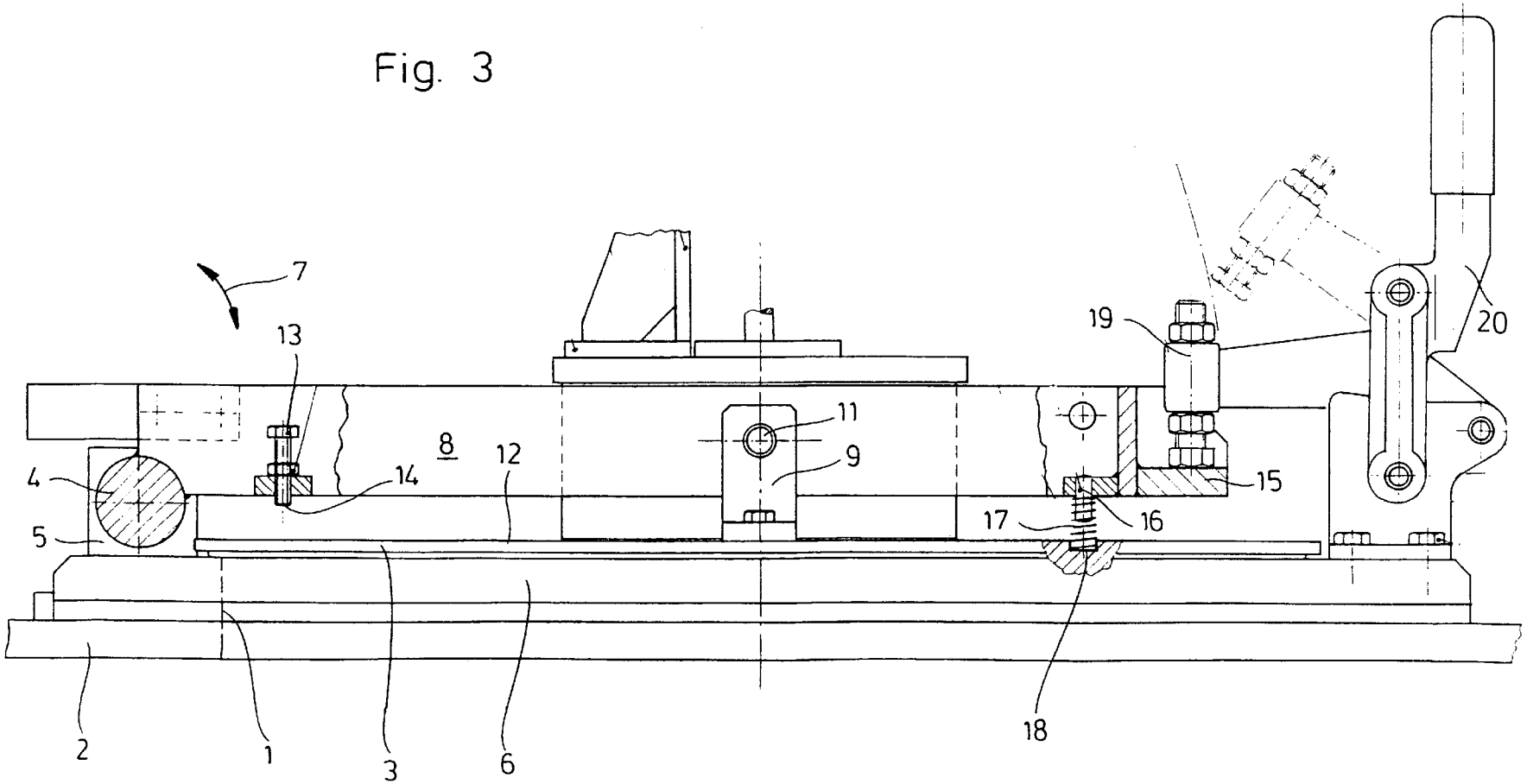
FIG. 3 is a side view of the lid taken in the direction B of FIG. 1.

The double lid lock is adapted to close the charging opening 1 in a bottom flange 6 of a base plate 2 of a containment, which is not shown in detail, but which, in a particular case, may be a working cell for handling contaminated, that is environmentally hazardous, materials. The charging opening 1 including the bottom flange 6 and the lid may be round, but other shapes such as square or oblong shapes may also be used.

In the double lid technique, the two lids of two containments which are to be joined in a sealed fashion are clamped together at the outside. In this process, the containments are interconnected. After the containments have been appropriately joined both lids are transferred together into one of the containments that is they are pivoted out of the openings into the interior of one of the containments by a pivot structure in such a way that the adjacent surfaces of the joined lids remain uncontaminated. The separation of the lids occurs in a reversed order. After separation, the surfaces of the lids which had been joined and which have remained uncontaminated are now disposed on the outside of each containment. In the double lid lock presented herein only one of the lids, that is the lid of one of the containments which can be pivoted out of the containment opening is shown in the drawings and is described as the arrangement otherwise remains unchanged from the double lid locks presently in use.

On the base plate 2, as shown in the figures, the one lid of the containment which is called here the closure lid 3 of such a double lid system, is supported on top of the bottom flange 6 on a pivot shaft 4 mounted on bearing blocks 5 so that it can be pivoted out of the opening 1, or respectively, lowered from the opening 1. The pivot shaft 4 should be disposed as close to the opening 1 as possible for space reasons. At the side of the double lid system opposite the pivot shaft 4, a clamping structure 19 with a handle 20 is mounted on the flange 6 whereby the closed lid is pressed down at the yoke 15 onto its seal and is held in a closed position. Other mounting or locking arrangements for the lid are possible using, for example, electric hydraulic or pneumatic actuating mechanisms.

The closing lid is mounted on the pivot shaft 14 in a special way:

Two spaced pivot arms 8 are welded to the pivot shaft 4 and the closing lid 3 is pivotally mounted on or below the two pivot arms 8 which are interconnected by the yoke 15. For this purpose, two additional bearing blocks 9 are mounted on the top side 12 of the closing lid 3 opposite the opening 1, which bearing blocks 9 receive bearing bolts 10 extending along the axis 11 by which the two pivot arms 8 are mounted to the closing lid 3. The closing lid 3 is therefore supported so as to be pivotable also about the axis 11. As already mentioned, the axis 11 is disposed on the top side 12, that is, the side of the closing lid 3, which is remote from the opening 1.

At the bottom side of the pivot arms 8 between the pivot shaft 4 and the axis 11, one or several space bolts are screwed into the pivot arms such that the ends of the bolts 13 engage the lid 3 and limit its tilting movability with regard to the pivot arm 8. Furthermore, one or several cylindrical pins 16 are arranged in the area of the transverse yoke 15, which pins 16 project toward the lid 3 and on which a compression spring 17 is disposed having a greater axial length than the pin 16. The lid 3 is provided with a recess 18 into which the spring 17 projects when the lid 3 abuts the flange 6.

The closing lids operation is as follows:

The closing lid is opened by pivoting the pivot arms 8 upwardly about the axis 4 along the arc of a circle by means of a winch or any other equipment. Since the lid 3 is supported on the pivot arms 8 so as to be pivotable about the axis 11 and, at the same time, changes its position relative to the pivot arms 8, it pivots until it abuts the tips 14 of the spacer bolts 13. Only then is the lid further pivoted in unison with the pivot arms 8. The lid 3 is pivoted fully open to a position in which it abuts the spacer bolts 13 of the pivot arms 8, the open pivot position of the lid 3 not being shown in the drawings.

During closing of the lid 3, the lid pivots shortly before being seated on the opening 1 into a horizontal position. At this point, the spring 17 engages the lid 3 in the recess 18 and presses onto the lid 3 which is now seated on the seal for the lid. If then, the lid is again lifted, it will remain for a short while subjected to the force of the spring 17, so that the lid moves first vertically upwardly before it is engaged by the spacer bolt and is then tilted fully open as described above.

The second lid which closes the container disposed below the wall 2 of the containment is attached to the lid 3 in the normal well known manner, which therefore does not need to be described.

What is claimed is:

1. A lid support arrangement for a double lid lock for closing the openings of two containments disposed adjacent one another for transferring noxious material between the two containments, one of said containments including a cover lid for sealing said opening, said cover lid being supported by two spaced pivot arms, which are pivotally supported at one of their ends so as to be rotatable about a first pivot axis and which extend over said cover lid, and said cover lid having at its side opposite said opening two spaced double bearing blocks with bearing bolts by which said cover lid is pivotally supported at a side thereof remote from said opening and about a second pivot axis which extends parallel to the pivot axis of said pivot arms, at least one spacer bolt mounted on said pivot arms between said pivot axes so as to project adjustably toward said cover lid for engaging said cover lid to limit its pivot movement relative to said pivot arms, at least one spring attached to said pivot arms at their side, with respect to said second axis, opposite to said spacer bolts, said spring projecting toward said lid and being seated in a recess formed in said lid when said lid is pivoted by the pivot arms to an opening or closing position, and a pin projecting from said pivot arms into said spring, said pin being shorter than said spring such that said lid is resiliently engaged when said lid, upon closing, pivots out of engagement with said pin.

* * * * *